US009177519B2

(12) United States Patent
Tsao et al.

(10) Patent No.: US 9,177,519 B2
(45) Date of Patent: Nov. 3, 2015

(54) DRIVING CIRCUIT

(71) Applicant: AU OPTRONICS CORP., Hsin-Chu (TW)

(72) Inventors: Sau-Wen Tsao, Hsin-Chu (TW); Yen-Ying Kung, Hsin-Chu (TW); Cho-Yan Chen, Hsin-Chu (TW); Mei-Ju Lu, Hsin-Chu (TW); Tien-Lun Ting, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 140 days.

(21) Appl. No.: 14/080,192

(22) Filed: Nov. 14, 2013

(65) Prior Publication Data

US 2014/0146032 A1 May 29, 2014

(30) Foreign Application Priority Data

Nov. 23, 2012 (TW) ..... 101144046 A
Jun. 7, 2013 (TW) ..... 102120435 A

(51) Int. Cl.
*G09G 3/36* (2006.01)

(52) U.S. Cl.
CPC ..... *G09G 3/3648* (2013.01); *G09G 3/3659* (2013.01); *G09G 2300/0447* (2013.01); *G09G 2300/0852* (2013.01); *G09G 2320/028* (2013.01)

(58) Field of Classification Search
CPC ..... G09G 3/3648; G09G 3/3659; G09G 2320/028
USPC ..... 345/92, 98, 212
See application file for complete search history.

(56) References Cited

U.S. PATENT DOCUMENTS

| | | | |
|---|---|---|---|
| 2010/0053528 | A1 | 3/2010 | Li et al. |
| 2010/0220124 | A1 | 9/2010 | Chen et al. |
| 2011/0242468 | A1 | 10/2011 | Choi et al. |

FOREIGN PATENT DOCUMENTS

| | | |
|---|---|---|
| CN | 101211078 | 7/2008 |
| CN | 102306486 | 1/2012 |
| CN | 102385205 | 3/2012 |
| CN | 102854675 | 1/2013 |
| CN | 102998861 | 3/2013 |
| EP | 2136247 | 12/2009 |

OTHER PUBLICATIONS

China Patent Office, "Office Action", Jan. 5, 2015.

*Primary Examiner* — Jonathan Blancha
(74) *Attorney, Agent, or Firm* — WPAT, PC; Justin King

(57) ABSTRACT

A driving circuit electrically coupled between a first data line and a second data line and between a first scan line and a second scan line. The driving circuit includes a first switch, a second switch, a third switch, a fourth switch, a first sub-capacitor, a second sub-capacitor, a fifth switch, a sixth switch, a first voltage dividing unit and a second voltage dividing unit. The first voltage dividing unit is coupled between a second end of the fifth switch and a reference voltage end. The second voltage dividing unit is coupled between a second end of the sixth switch and the reference voltage end, for redistributing stored electric charges.

10 Claims, 10 Drawing Sheets

DRIVING CIRCUIT

CROSS-REFERENCE TO RELATED APPLICATIONS

This non-provisional application claims priority under 35 U.S.C. §119(a) on Patent Application No(s). 101144046 and 102120435 respectively filed in Taiwan, R.O.C. on Nov. 23, 2012 and Jun. 7, 2013, the entire contents of which are hereby incorporated by reference.

TECHNICAL FIELD

The disclosure relates to a driving circuit, and more particularly to a driving circuit for enhancing the transmittance of a pixel.

BACKGROUND

With the development of liquid crystal display devices with large size, to overcome the viewing angle problem of large-size displays, ongoing advancements and breakthroughs are required for wide viewing angle technologies of liquid crystal display panels accordingly. Until now, technologies that are capable of satisfying the wide viewing angle requirement include, for example, the multi-domain vertical alignment (MVA), the multi-domain horizontal alignment (MHA), the twisted nematic film (TN+film) and the In-Plane Switching (IPS).

Through the technologies listed above, a liquid crystal display may have a wide viewing angle. However, a color washout problem occurs. Generally, the so-called color washout indicates that a user sees a video image of different grayscales when viewing the video image, displayed by a liquid crystal display, from different viewing angles. For example, if a user views a video image, displayed by a liquid crystal display, from a large angle (for example, 60 degrees), the hue of the video image at the side view is higher than the hue of the video image at the right angle view.

To solve the problem of color washout of a liquid crystal display with a large viewing angle, currently it is proposed that each pixel in a liquid crystal display panel is divided into two pixels capable of being independently driven. One pixel displays a color of a high grayscale (bright state), and the other pixel displays a color of a low grayscale (dark state). Therefore, after the color of a high grayscale and the color of a low grayscale are mixed to form a color of an intermediate grayscale, a video image having a similar hue can be viewed no matter if the user views the video picture, displayed by the liquid crystal display, in right front of the liquid crystal display or from an angle.

Until now, liquid crystal displays employ electrodes on the same plane and a vertical alignment liquid crystal use a drive method of electrodes at the same plane. The tilt degrees of liquid crystal molecules depend on electrical field intensity (E), the electrical field intensity (E) depends on an electrode spacing (d) and a drive voltage (V). The relation may be expressed as $E=V/d$. Therefore, it can be known that the electrical field intensity is affected by an electrode spacing and a drive voltage.

To correct the color washout, multiple groups of electrode spacings are usually designed, so that pixels can support the wide viewing angle. In the design of electrode spacings, it is expected that the ratio between the pixel area of a wide electrode spacing and the pixel area of a narrow electrode spacing is about 7:3.

However, for a wide electrode spacing, a high data drive voltage is required to generate a sufficient electrical field, so that liquid crystal molecules have a large tilt angle for achieving a sufficient transmittance. For example, an electrode spacing larger than 16 um requires a voltage of at least 16 V to approximate a saturated degree for driving pixels. The output voltage of an integrated circuit until now is 16 V at most, so that the voltage difference, used for controlling the liquid crystal, between two electrodes is insufficient to drive a pixel having an electrode spacing larger than 16 um. This causes the pixel having a wide electrode spacing has an undesirable transmittance performance, and then such a wider electrode spacing fails to be utilised to correct the color washout at the side view.

SUMMARY

A driving circuit disclosed in an embodiment of the disclosure is electrically coupled between a first data line and a second data line and between a first scan line and a second scan line. The driving circuit comprises a first switch, a second switch, a third switch, a fourth switch, a first sub-capacitor, a second sub-capacitor, a fifth switch, a sixth switch, a first voltage-divider and a second voltage-divider. The first switch has a first end, a second end and a control end. The first end of the first switch is electrically connected to the first data line, the second end of the first switch is electrically connected to a first pixel electrode, and the control end of the first switch is electrically connected to the first scan line. The second switch has a first end, a second end and a control end. The first end of the second switch is electrically connected to the second data line, the second end of the second switch is electrically connected to a second pixel electrode, and the control end of the second switch is electrically connected to the first scan line. The third switch has a first end, a second end and a control end. The first end of the third switch is electrically connected to the first data line, and the control end of the third switch is electrically connected to the first scan line. The fourth switch has a first end, a second end and a control end. The first end of the fourth switch is electrically connected to the second data line, and the control end of the fourth switch is electrically connected to the first scan line. The first sub-capacitor is electrically connected between the second end of the third switch and a reference voltage end. The second sub-capacitor is electrically connected between the second end of the fourth switch and the reference voltage end. The fifth switch has a first end, a second end and a control end. The first end of the fifth switch is electrically connected to the second end of the third switch, and the control end of the fifth switch is electrically connected to the second scan line. The sixth switch has a first end, a second end and a control end. The first end of the sixth switch is electrically connected to the second end of the fourth switch, and the control end of the sixth switch is electrically connected to the second scan line. The first voltage dividing unit is coupled between the second end of the fifth switch and the reference voltage end. The second voltage dividing unit is coupled between the second end of the sixth switch and the reference voltage end.

A driving circuit disclosed in an embodiment of the disclosure is electrically coupled between a first data line and a second data line, and is electrically coupled between a first scan line and a second scan line. The driving circuit comprises a first switch, a second switch, a third switch, a fourth switch, a first sub-capacitor, a second sub-capacitor, a fifth switch, a sixth switch, a first voltage dividing unit, a second voltage dividing unit, a third pixel electrode and a fourth pixel electrode. The first switch has a first end, a second end and a control end. The first end of the first switch is electrically connected to the first data line, the second end of the first switch is electrically connected to a first pixel electrode, and the control end of the first switch is electrically connected to the first scan line. The second switch has a first end, a second end and a control end. The first end of the second switch is electrically connected to the second data line, the second end of the second switch is electrically connected to a second pixel electrode, and the control end of the second switch is electrically connected to the first scan line. The third switch has a first end, a second end and a control end. The first end of the third switch is electrically connected to the first data line, and the control end of the third switch is electrically connected to the first scan line. The fourth switch has a first end, a second end and a control end. The first end of the fourth switch is electrically connected to the second data line, and the control end of the fourth switch is electrically connected to the first scan line. The first sub-capacitor is electrically connected between the second end of the third switch and a reference voltage end. The second sub-capacitor is electrically connected between the second end of the fourth switch and the reference voltage end. The fifth switch has a first end, a second end and a control end. The first end of the fifth switch is electrically connected to the second end of the third switch, and the control end of the fifth switch is electrically connected to the second scan line. The sixth switch has a first end, a second end and a control end. The first end of the sixth switch is electrically connected to the second end of the fourth switch, and the control end of the sixth switch is electrically connected to the second scan line. The first voltage dividing unit is coupled between the second end of the fifth switch and the reference voltage end. The second voltage dividing unit is coupled between the second end of the sixth switch and the reference voltage end. The third pixel electrode is electrically connected to the second end of the third switch, and the fourth pixel electrode is electrically connected to the second end of the fourth switch. The circuit layout of the driving circuit comprises a first section and a second section which do not overlap each other. An area ratio to the first section and the second section is between 5:95 and 70:30. The first pixel electrode and the second pixel electrode are disposed in the first section, and the third pixel electrode and the fourth pixel electrode are disposed in the second section.

BRIEF DESCRIPTION OF THE DRAWINGS

The disclosure will become more fully understood from the detailed description given herein below for illustration only and thus does not limit the disclosure, wherein.

DETAILED DESCRIPTION

Figure 1:
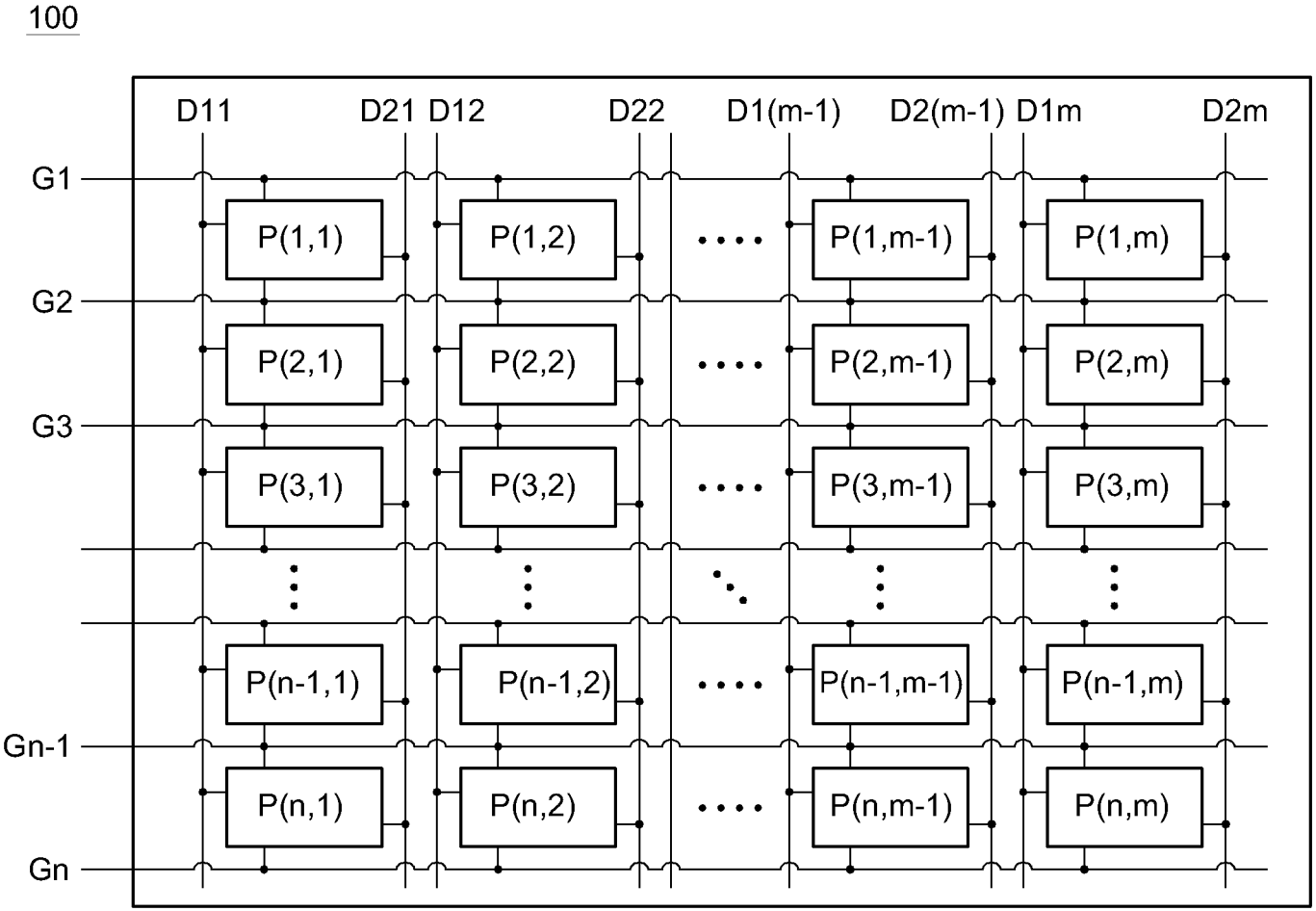
FIG. 1 is a schematic view of a pixel matrix in the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 is a schematic view of a circuit structure of a pixel matrix 100. The pixel matrix 100 comprises a plurality of scan lines G1 to Gn, a plurality of first data lines D11 to D1*m*, a plurality of second data lines D21 to D2*m*, and a plurality of pixels P(1,1) to P(n,m). In an example of the connection manner of pixel matrix, the first pixel P(1,1) is electrically connected to the corresponding scan line G1 and the corresponding scan line G2, and the first pixel P(1,1) is electrically connected to the corresponding first data line D11 and the corresponding second data line D21. The first pixel P(1,1) in the pixel matrix 100 is a driving circuit 200, which is described below.

Figure 2A:
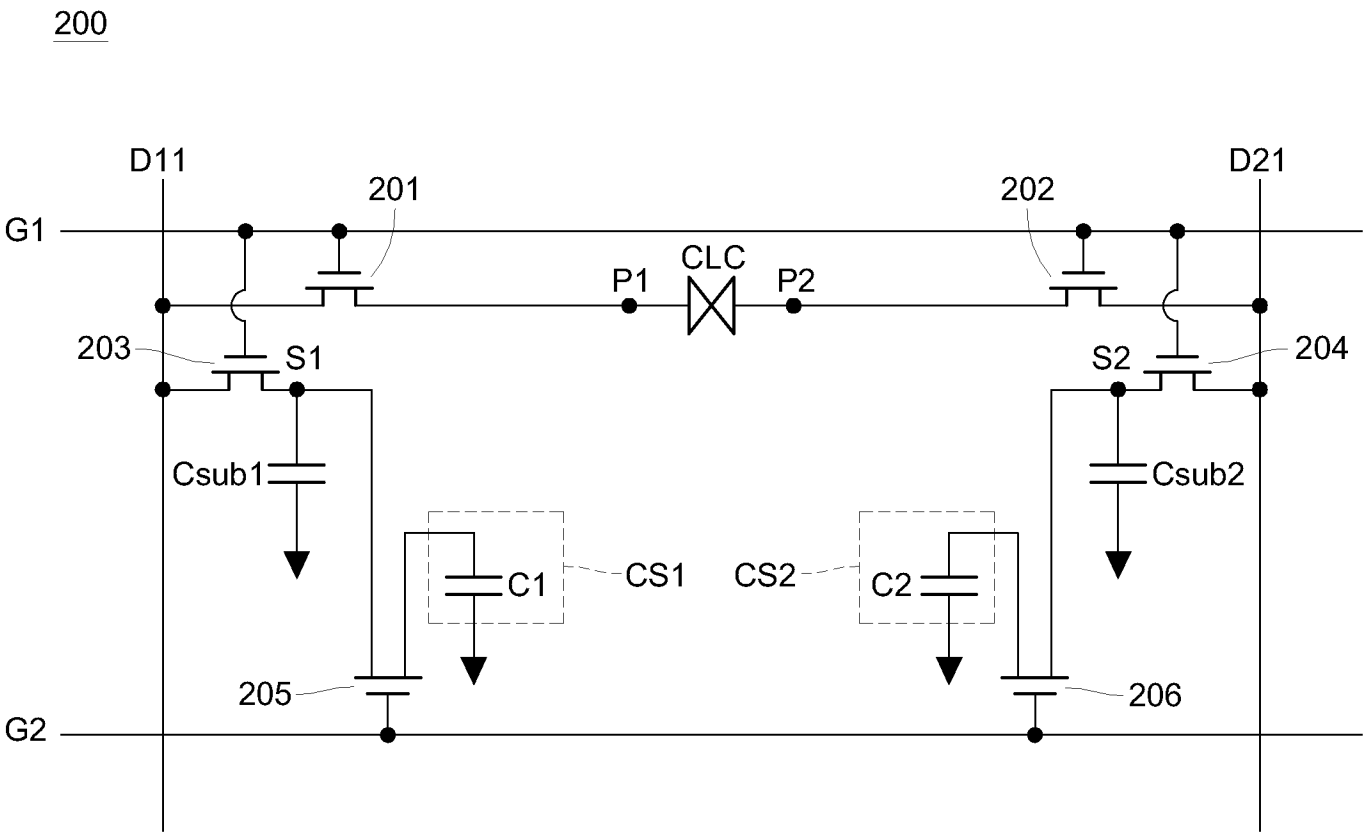
FIG. 2A is a schematic circuit diagram of a driving circuit in the disclosure.

FIG. 2A is a circuit diagram of a driving circuit 200, and mainly the first pixel P(1,1) in FIG. 1 is taken for illustration. The driving circuit 200 is electrically coupled between the first data line D11 and the second data line D21, and electrically coupled between the scan line G1 and the scan line G2. The driving circuit 200 includes a first switch 201, a second switch 202, a third switch 203, a fourth switch 204, a first pixel electrode P1, a second pixel electrode P2, a first sub-capacitor Csub1, a second sub-capacitor Csub2, a fifth switch 205, a sixth switch 206, a first voltage dividing unit CS1 and a second voltage dividing unit CS2. The first voltage dividing unit CS1 includes a first capacitor C1 (the first voltage divider), and the second voltage dividing unit CS2 includes a second capacitor C2 (the second voltage divider).

The first switch 201 is a transistor and has a first end, a second end and a control end. The first end of the first switch 201 is electrically connected to the first data line D11, the second end of the first switch 201 is electrically connected to the first pixel electrode P1, and the control end of the first switch 201 is electrically connected to the scan line G1. The second switch 202 is a transistor and has a first end, a second end and a control end. The first end of the second switch 202 is electrically connected to the second data line D21, the second end of the second switch 202 is electrically connected to the second pixel electrode P2, and the control end of the second switch 202 is electrically connected to the scan line G1. The third switch 203 is a transistor and has a first end, a second end and a control end. The first end of the third switch 203 is electrically connected to the first data line D11, and the control end of the third switch 203 is electrically connected to the scan line G1. The fourth switch 204 is a transistor and has a first end, a second end and a control end. The first end of the fourth switch 204 is electrically connected to the second data line D21, and the control end of the fourth switch 204 is electrically connected to the scan line G1. The first pixel electrode P1 and the second pixel electrode P2 have a spacing therebetween to form a liquid crystal capacitor CLC, and a voltage difference Vlc exists between the first pixel electrode P1 and the second pixel electrode P2. The first sub-capacitor Csub1 has a first end and a second end and is electrically connected between the second end of the third switch 203 and a reference voltage end. The second sub-capacitor Csub2 has a first end and a second end and is electrically connected between the second end of the fourth switch 204 and the reference voltage end. The fifth switch 205 is a transistor and has a first end, a second end and a control end. The first end of the fifth switch 205 is electrically connected to the second end of the third switch 203, the control end of the fifth switch 205 is electrically connected to the scan line G2, and the second end of the fifth switch 205 is electrically connected to the first end of the first capacitor C1. The first capacitor C1 has a first end and a second end and is coupled between the second end of the fifth switch 205 and the reference voltage end. The sixth switch 206 is a transistor and has a first end, a second end and a control end. The second end of the sixth switch 206 is electrically connected to the first end of the second capacitor C2, the control end of the sixth switch 206 is electrically connected to the scan line G2, and the first end of the sixth switch 206 is electrically connected to the second end of the fourth switch 204. The second capacitor C2 has a first end and a second end and is electrically connected between the second end of the sixth switch 206 and the reference voltage end.

Figure 2B:
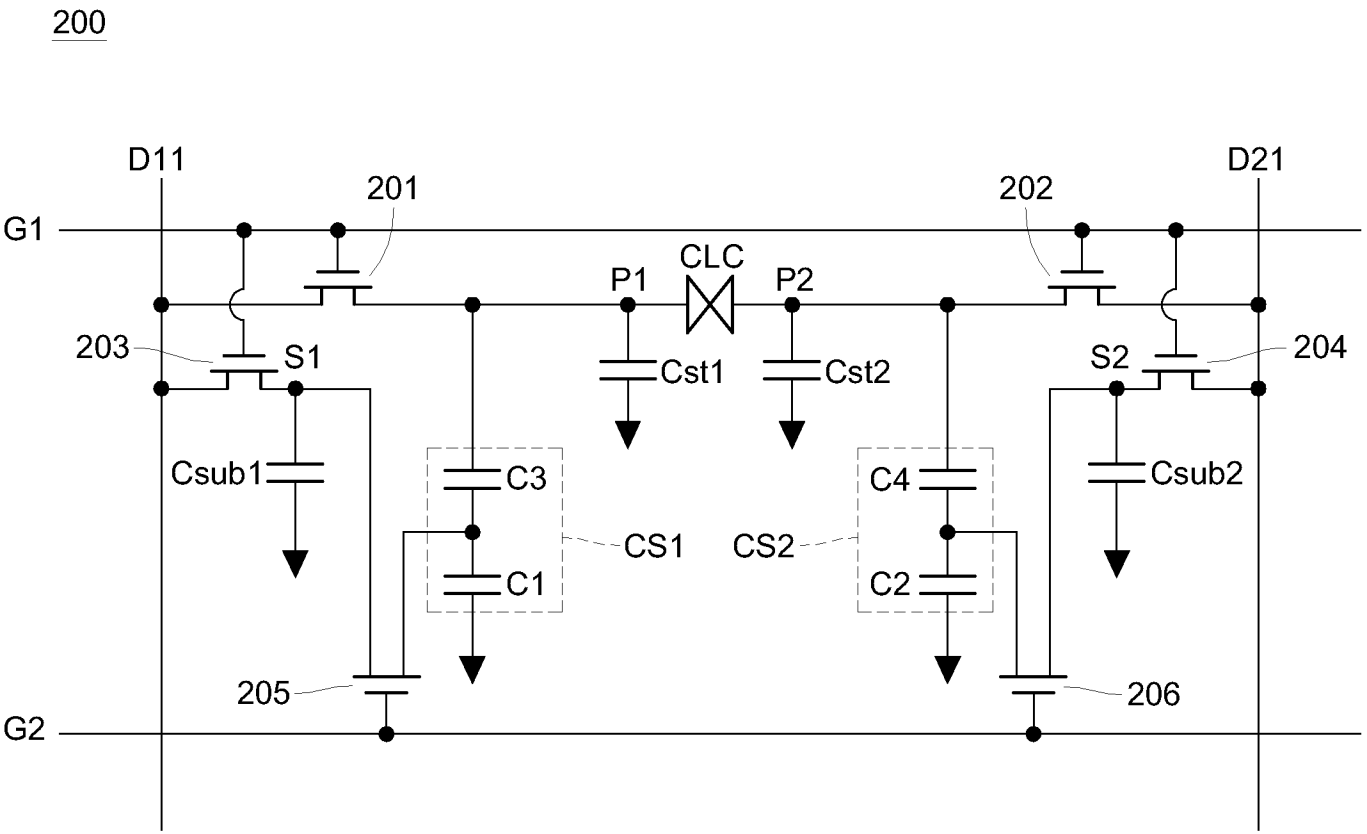
FIG. 2B is a schematic circuit diagram of a driving circuit in the disclosure.

Referring to FIG. 2B, in this and some other embodiments, the driving circuit 200 of the disclosure further includes a first storage capacitor Cst1, a second storage capacitor Cst2, the first voltage dividing unit CS1 further includes a third capacitor C3, and the second voltage dividing unit CS2 further includes a fourth capacitor C4. The first storage capacitor Cst1 has a first end and a second end. The first end of the first storage capacitor Cst1 is electrically connected to the second end of the first switch 201, and the second end of the first storage capacitor Cst1 is electrically connected to the reference voltage end. The second storage capacitor Cst2 has a first end and a second end. The first end of the second storage capacitor Cst2 is electrically connected to the second end of the second switch 202, and the second end of the second storage capacitor Cst2 is electrically connected to the reference voltage end. The third capacitor C3 has a first end and a second end and is electrically connected between the first capacitor C1 and the first pixel electrode P1. The fourth capacitor C4 has a first end and a second end and is electrically connected between the second capacitor C2 and the second pixel electrode P2.

Figure 3:
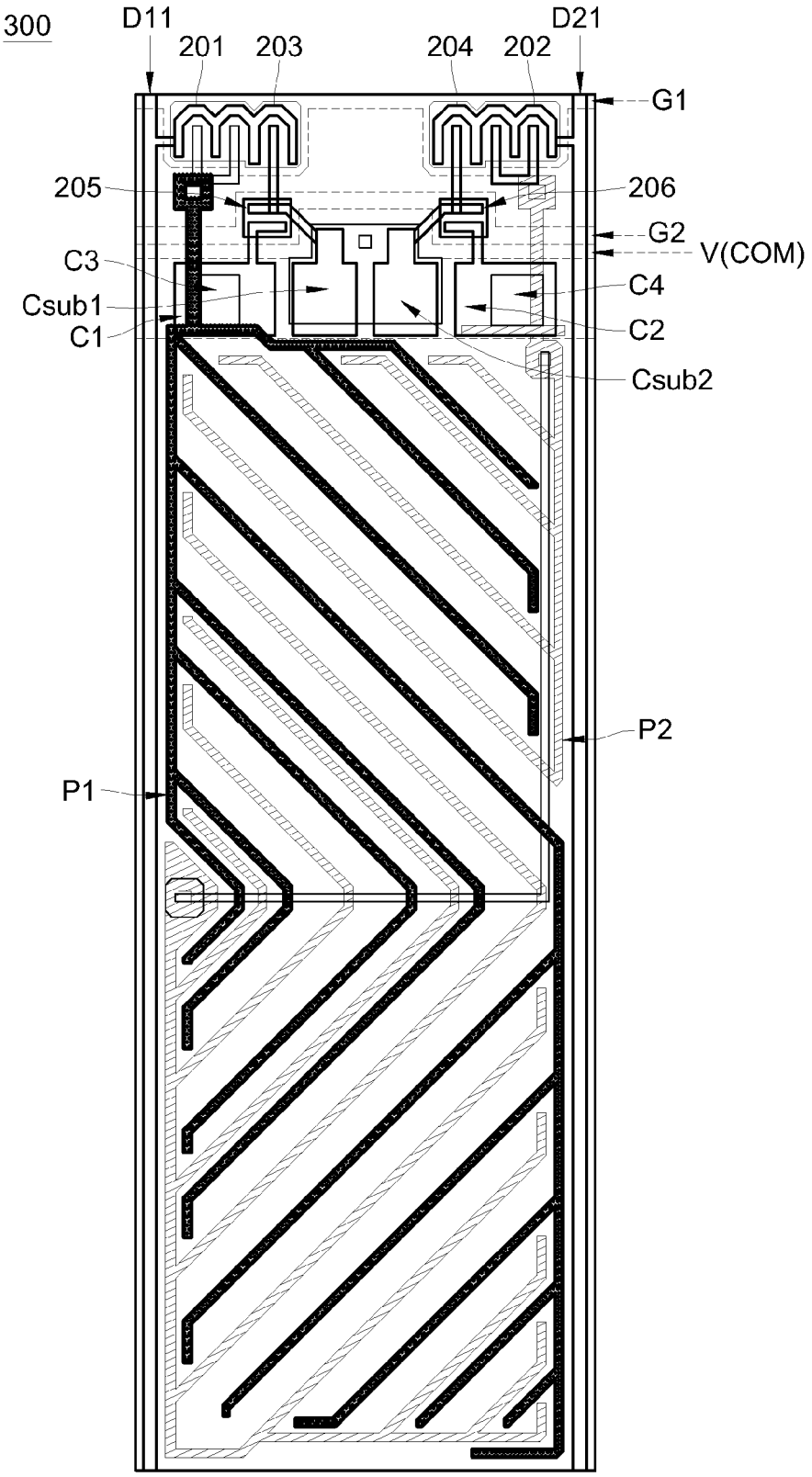
FIG. 3 is a schematic view of a pixel array circuit layout of a driving circuit in the disclosure.

FIG. 3 is a schematic view of a pixel array circuit layout 300 of the driving circuit 200 of the disclosure. To correspond to the above embodiment, the same label is adopted for the same elements. The pixel array circuit layout 300 includes a first switch 201, a second switch 202, a third switch 203, a fourth switch 204, a fifth switch 205, a sixth switch 206, a first sub-capacitor Csub1, a second sub-capacitor Csub2, a first capacitor C1, a second capacitor C2, a third capacitor C3, a fourth capacitor C4, two scan lines G1 and G2, a first data line D11 and a second data line D21. The scan line G1 and the scan line G2 practically intersect the first data line D11 and the second data line D21 perpendicularly, and each switch is connected to the scan line and the data line. The first switch 201 is electrically connected to the scan line G1 and the first data line D11. The second switch 202 is electrically connected to the scan line G1 and the second data line D21. The third switch 203 is electrically connected to the scan line G1 and the first data line D11. The fourth switch 204 is electrically connected to the scan line G1 and the second data line D21. The fifth switch 205 and the sixth switch 206 are electrically connected to the scan line G2. The third switch 203 is electrically connected to the scan line G1 and the fifth switch 205. The third switch 203 and the fifth switch 205 are electrically connected to the first sub-capacitor Csub1 and are adjacent to the first capacitor C1 and the third capacitor C3. In addition, the fourth switch 204 is electrically connected to the scan line G1 and the sixth switch 206, the fourth switch 204 and the sixth switch 206 are electrically connected to the second sub-capacitor Csub2 adjacent to the second capacitor C2 and the fourth capacitor C4. The first pixel electrode P1 is a finger electrode, and is electrically connected to the first switch 201 and the third capacitor C3. The second pixel electrode P2 is a finger electrode, and is electrically connected to the second switch 202 and the fourth capacitor C4. A common electrode V (COM) is disposed between the first data line D11 and the second data line D21. The drive method and operation of the driving circuit 200 are illustrated as follows.

Figure 4:
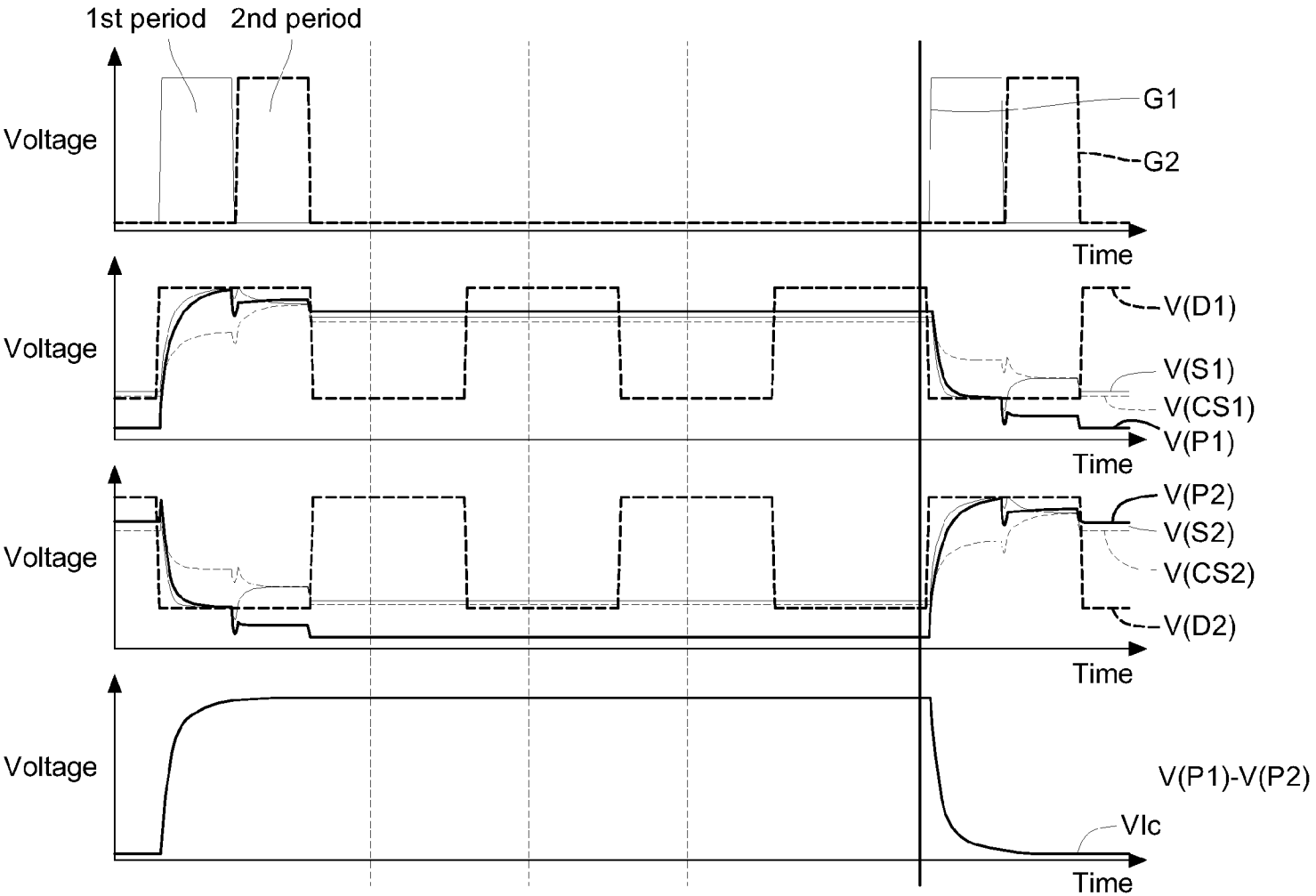
FIG. 4 is a simulation waveform diagram of a driving circuit in the disclosure.

FIG. 4 is a simulation waveform diagram of the driving circuit 200 in FIG. 2A of the disclosure. When a first data voltage is at a positive potential, a second data voltage is at a negative potential. When the scan line G1 is enabled in a first interval of one period, the first switch 201, the second switch 202, the third switch 203 and the fourth switch 204 are turned on. Herein, the first data voltage is supplied to the first sub-capacitor Csub1 and a first storage capacitor Cst1 through the first data line D11, and the second data voltage is supplied to the second sub-capacitor Csub2 and a second storage capacitor Cst2 through the second data line D21. Thus, the first voltage dividing unit CS1 maintains the potential at a previous period, the second voltage dividing unit CS2 maintains the potential at the previous period, and the potentials of the first pixel electrode P1, the second pixel electrode P2 and a node S1 and a node S2 are changed to the potential of a corresponding data voltage.

Subsequently, in a second period, when the scan line G1 is disable and the scan line G2 is enabled, the fifth switch 205 and the sixth switch 206 are turned on, the first data voltage maintained by the first sub-capacitor Csub1 and the first voltage dividing unit CS1 is redistributed, and the second data voltage maintained by the second sub-capacitor Csub2 and the second voltage dividing unit CS2 is redistributed. In other words, the charges originally stored in the first sub-capacitor Csub1 and the second sub-capacitor Csub2 are redistributed via the first capacitor C1 and the second capacitor C2. Specifically, the node S1 shares charges with the first voltage dividing unit CS1, and the second voltage dividing unit CS2 shares charges with the node S2. Thus, the potential of the node S1 and the potential of the first voltage dividing unit CS1 become equal, and the potential of the node S2 and the potential of the second voltage dividing unit CS2 become equal.

FIG. 4 is a simulation waveform diagram of the driving circuit 200 in FIG. 2B of the disclosure. The driving circuit 200 in FIG. 2A is basically similar to the driving circuit 200 in FIG. 2B, and the differences therebetween are that the first voltage dividing unit CS1 further includes a third capacitor C3, and that the second voltage dividing unit CS2 further includes a fourth capacitor C4. When the first data voltage is at a positive potential, the second data voltage is at a negative potential.

In a first interval of one period, the scan line G1 is enabled, and the first switch 201, the second switch 202, the third switch 203 and the fourth switch 204 are turned on. Herein, a first data voltage is supplied to the first sub-capacitor Csub1 and a first storage capacitor Cst1 through the first data line D11, and a second data voltage is supplied to the second sub-capacitor Csub2 and a second storage capacitor Cst2 through the second data line D21. Thus, the potential of the voltage V(CS1) of the first voltage dividing unit CS1 is changed from the potential at a previous period to a higher potential, the potential of the voltage V(CS2) of the second voltage dividing unit CS2 is changed to a lower potential, and the potentials of the first pixel electrode P1, the second pixel electrode P2, a node S1 and a node S2 are changed to the potential of a corresponding data voltage.

Subsequently, in a second period, when the scan line G1 is disabled and the scan line G2 is enabled, the fifth switch 205 and the sixth switch 206 are turned on. Thus, the first data voltage V(D1) maintained by the first sub-capacitor Csub1 and the first voltage dividing unit CS1 is redistributed, and the second data voltage V(D2) maintained by the second sub-capacitor Csub2 and the second voltage dividing unit CS2 is redistributed. In other words, the charges originally stored in the first sub-capacitor Csub1 and the second sub-capacitor Csub2 are redistributed via the first capacitor C1 and the second capacitor C2. Specifically, the node S1 shares charges with the first voltage dividing unit CS1, and the second voltage dividing unit CS2 shares charges with the node S2. Thus, the potential of the node S1 and the potential of the first voltage dividing unit CS1 become equal, and the potential of the node S2 and the potential of the second voltage dividing unit CS2 become equal, the potential of the voltage V(P1) of the first pixel electrode P1 is changed to a higher potential, and the potential of the voltage V(P2) of the second pixel electrode P2 is changed to a lower potential. A voltage difference Vlc between the first pixel electrode P1 and the second pixel electrode P2 in the driving circuit 200 is equal to the voltage V(P1) minus the voltage V(P2) and is increased to a value higher than a drive range of data voltage.

In the first period, when the scan line G1 is enabled, the first switch 201, the second switch 202, the third switch 203 and the fourth switch 204 are turned on. Herein, a first data voltage V(D1) is supplied, and the voltage V(P1) of the first pixel electrode P1 and the voltage V(S1) of the node S1 increase with the first data voltage V(D1). Moreover, a second data voltage V(D2) is also supplied, and the voltage V(P2) of the second pixel electrode P2 and the voltage V(S2) of the node S2 decrease with the second data voltage V(D2). Thus, the first pixel electrode P1 and the node S1 are fully charged via the first data line D11 to become positive electrodes, and the second pixel electrode P2 and the node S2 are fully charged via the second data line D21 to become negative electrodes.

Subsequently, in the second period, when the scan line G1 is disabled and the scan line G2 is enabled, the first switch 201, the second switch 202, the third switch 203 and the fourth switch 204 are turned off, and the fifth switch 205 and the sixth switch 206 are turned on. Herein, the charges stored in the first sub-capacitor Csub1 are redistributed via the first capacitor C1. After the charges are shared, the voltage V(P1) of the first pixel electrode P1 increases while the voltage V(S1) of the node S1 decreases. Simultaneously, the charges stored in the second sub-capacitor Csub2 are redistributed via the second capacitor C2, and the voltage V(P2) of the second pixel electrode P2 decreases while the voltage V(S2) of the node S2 increases. Accordingly, the voltage difference Vlc between the first pixel electrode P1 and the second pixel electrode P2 is enhanced.

Figure 5:
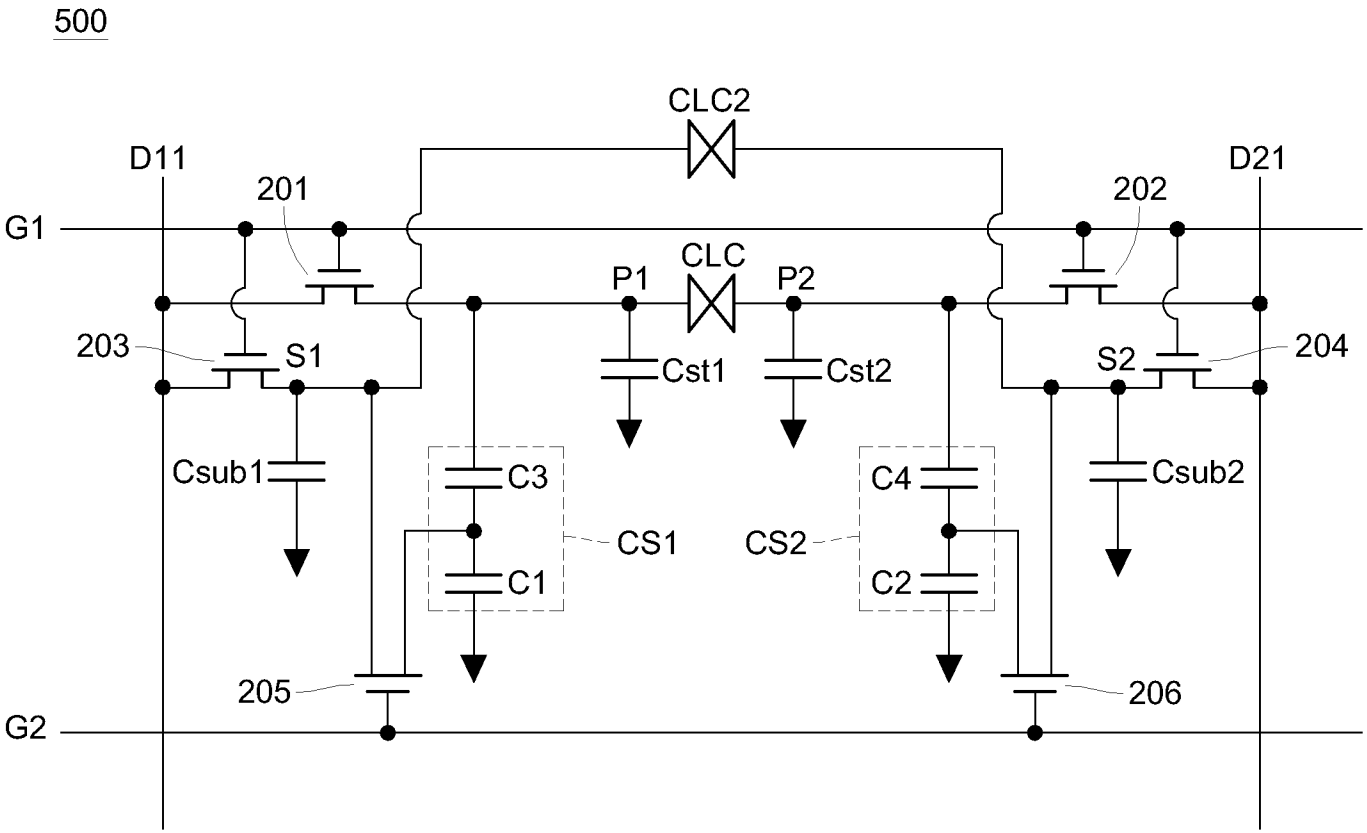
FIG. 5 is a schematic circuit diagram of a driving circuit in the disclosure.

FIG. 5 is a circuit diagram of a driving circuit 500 according to another embodiment of the disclosure. This embodiment is basically the same as the driving circuit 200. In addition, the driving circuit 500 further includes a third pixel electrode S1 and a fourth pixel electrode S2. The third pixel electrode S1 and the fourth pixel electrode S2 have a spacing therebetween to form a second liquid crystal capacitor CLC2, and a voltage difference Vlc2 exists between the third pixel electrode S1 and the fourth pixel electrode S2.

The first pixel electrode P1 and the second pixel electrode P2 have a wider spacing therebetween, and the third pixel electrode S1 and the fourth pixel electrode S2 have a narrower spacing therebetween. Thus, the second liquid crystal capacitor CLC2 has the functions of the first sub-capacitor Csub1 and the second sub-capacitor Csub2, thereby reducing the layout area occupied by the first sub-capacitor Csub1 and the second sub-capacitor Csub2. This causes that an aperture ratio may be increased, that a voltage difference between pixel electrodes may be increased, and that the color washout may be reduced at the side view. On the other hand, the second liquid crystal capacitor CLC2 formed between the third pixel electrode S1 and the fourth pixel electrode S2 does not require a very high voltage difference Vlc2 between the third pixel electrode S1 and the fourth pixel electrode S2, so can share charges with the liquid crystal capacitor CLC formed between the first pixel electrode P1 and the second pixel electrode P2, thereby increasing the voltage difference Vlc1 between the electrodes of the liquid crystal capacitor CLC. The third pixel electrode S1 and the fourth pixel electrode S2 on the circuit diagram are illustrated via the nodes.

The driving circuit 500 is electrically coupled between a first data line D11 and a second data line D21 and is electrically coupled between a scan line G1 and a scan line G2. The driving circuit 200 includes a first switch 201, a second switch 202, a third switch 203, a fourth switch 204, a first pixel electrode P1, a second pixel electrode P2, a third pixel electrode S1, a fourth pixel electrode S2, a liquid crystal capacitor CLC, a second liquid crystal capacitor CLC2, a first storage capacitor Cst1, a second storage capacitor Cst2, a first sub-capacitor Csub1, a second sub-capacitor Csub2, a first voltage dividing unit CS1 and a second voltage dividing unit CS2.

The first switch 201 is a transistor and has a first end, a second end and a control end. The first end of the first switch 201 is electrically connected to the first data line D11, the second end of the first switch 201 is electrically connected to the first pixel electrode P1, and the control end of the first switch 201 is electrically connected to the scan line G1. The second switch 202 is a transistor and has a first end, a second end and a control end. The first end of the second switch 202 is electrically connected to the second data line D21, the second end of the second switch 202 is electrically connected to the second pixel electrode P2, and the control end of the second switch 202 is electrically connected to the scan line G1. The third switch 203 is a transistor and has a first end, a second end and a control end. The first end of the third switch 203 is electrically connected to the first data line D11, the second end of the third switch 203 is electrically connected to the third pixel electrode S1, and the control end of the third switch 203 is electrically connected to the scan line G1. The fourth switch 204 is a transistor and has a first end, a second end and a control end. The first end of the fourth switch 204 is electrically connected to the second data line D21, the second end of the fourth switch 204 is electrically connected to the fourth pixel electrode S2, and the control end of the fourth switch 204 is electrically connected to the scan line G1.

The first storage capacitor Cst1 has a first end and a second end, the first end of the first storage capacitor Cst1 is electrically connected to the second end of the first switch 201, and the second end of the first storage capacitor Cst1 is electrically connected to a reference voltage end. The second storage capacitor Cst2 has a first end and a second end, the first end of the second storage capacitor Cst2 is electrically connected to the second end of the second switch 202, and the second end of the second storage capacitor Cst2 is electrically connected to the reference voltage end. The first sub-capacitor Csub1 is electrically connected between the second end of the third switch 203 and the reference voltage end. The second sub-capacitor Csub2 is electrically connected between the second end of the fourth switch 204 and the reference voltage end.

The fifth switch 205 is a transistor and has a first end, a second end and a control end. The first end of the fifth switch 205 is electrically connected to the second end of the third switch 203, the control end of the fifth switch 205 is electrically connected to the scan line G2, and the second end of the fifth switch 205 is electrically connected to the first voltage dividing unit CS1, so as to redistribute charges stored among the first sub-capacitor Csub1, the first storage capacitor Cst1 and the first voltage dividing unit CS1. The sixth switch 206 is a transistor and has a first end, a second end and a control end. The first end of the sixth switch 206 is electrically connected to the second end of the fourth switch 204, the control end of the sixth switch 206 is electrically connected to the scan line G2, and the second end of the sixth switch 206 is electrically connected to the second voltage dividing unit CS2, so as to redistribute charges stored among the second sub-capacitor Csub2, the second storage capacitor Cst2 and the second voltage dividing unit CS2.

The first voltage dividing unit CS1 includes a first capacitor C1 having a first end and a second end, the first end of the first capacitor C1 is electrically connected to the second end of the fifth switch 205, and the second end of the first capacitor C1 is electrically connected to a reference voltage end. The second voltage dividing unit CS2 includes a second capacitor C2 having a first end and a second end, the first end of the second capacitor C2 is electrically connected to the second end of the sixth switch 206, and the second end of the second capacitor C2 is electrically connected to the reference voltage end.

In another embodiment of the disclosure, the first voltage dividing unit CS1 includes a first capacitor C1 and a third capacitor C3, which are connected in series and have a first end and a second end respectively, and is electrically connected between the second end of first switch 201 and the reference voltage end. The first end of the first capacitor C1 and the second end of the third capacitor C3 are electrically connected to the second end of the fifth switch 205. The first end of the third capacitor C3 is electrically connected to the second end of the first switch 201. The second end of the first capacitor C1 is electrically connected to the reference voltage end.

The second voltage dividing unit CS2 includes a second capacitor C2 and a fourth capacitor C4, which are connected in series and have a first end and a second end respectively, and is electrically connected between the second end of the second switch 202 and the reference voltage end. The first end of the second capacitor C2 and the second end of the fourth capacitor C4 are electrically connected to the second end of the sixth switch 206. The first end of the fourth capacitor C4 is electrically connected to the second end of the second switch 202. The second end of the second capacitor C2 is electrically connected to the reference voltage end.

Figure 6:
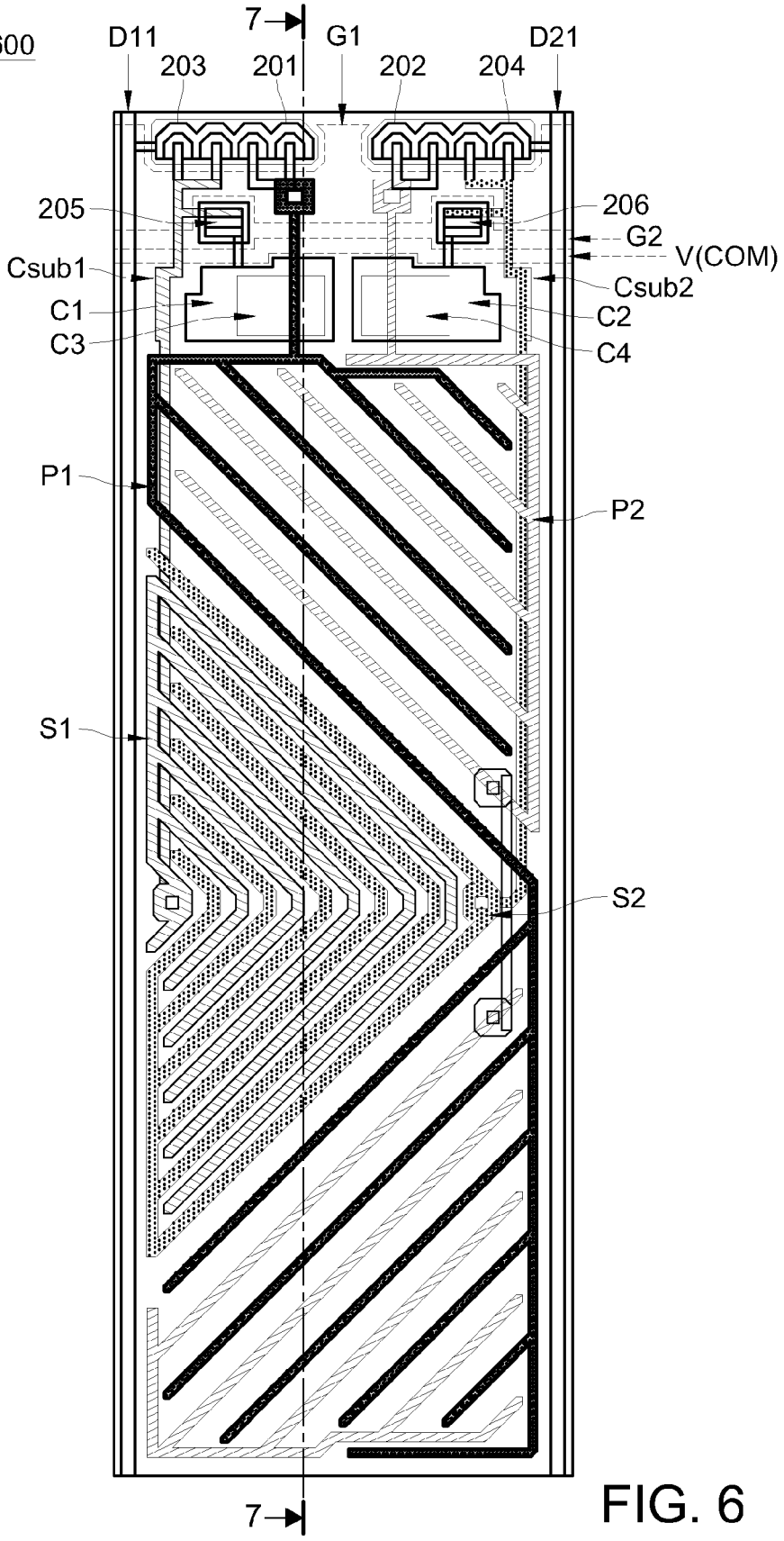
FIG. 6 is a schematic view of a pixel array circuit layout of a driving circuit in the disclosure.

FIG. 6 is a schematic view of a pixel array circuit layout 600 according to another embodiment of the disclosure. Here, to be corresponding to the embodiments above, the same label is employed for the same elements. The pixel array circuit layout 600 includes a first switch 201, a second switch 202, a third switch 203, a fourth switch 204, a fifth switch 205, a sixth switch 206, a first sub-capacitor Csub1, a second sub-capacitor Csub2, a first capacitor C1, a second capacitor C2, a third capacitor C3, a fourth capacitor C4, a scan line G1, a scan line G2, a first data line D11 and a second data line D21.

The scan line G1 and the scan line G2 intersect the first data line D11 and the second data line D21, and each switch is connected to the scan line and the data line. The first switch 201 is electrically connected to the scan line G1 and the first data line D11. The second switch 202 is electrically connected to the scan line G1 and the second data line D21. The third switch 203 is electrically connected to the scan line G1 and the first data line D11. The fourth switch 204 is electrically connected to the scan line G1 and the second data line D21. The fifth switch 205 and the sixth switch 206 are electrically connected to the scan line G2. The third switch 203 is electrically connected to the scan line G1 and the fifth switch 205. The third switch 203 and the fifth switch 205 are electrically connected to the first sub-capacitor Csub1 and are adjacent to the first capacitor C1 and the third capacitor C3. In addition, the fourth switch 204 is electrically connected to the scan line G1 and the sixth switch 206, and the second sub-capacitor Csub2 is adjacent to the second capacitor C2 and the fourth capacitor C4.

The first pixel electrode P1 is a finger electrode and is electrically connected to the first switch 201 and the third capacitor C3. The second pixel electrode P2 is a finger electrode and is electrically connected to the second switch 202 and the fourth capacitor C4. The third pixel electrode S1 is a finger electrode and is electrically connected to the fifth switch 205 and the first sub-capacitor Csub1. The fourth pixel electrode S2 is a finger electrode and is electrically connected to the sixth switch 206 and the second sub-capacitor Csub2. A common electrode V(COM) is disposed between the first data line D11 and the second data line D21.

Figure 7:
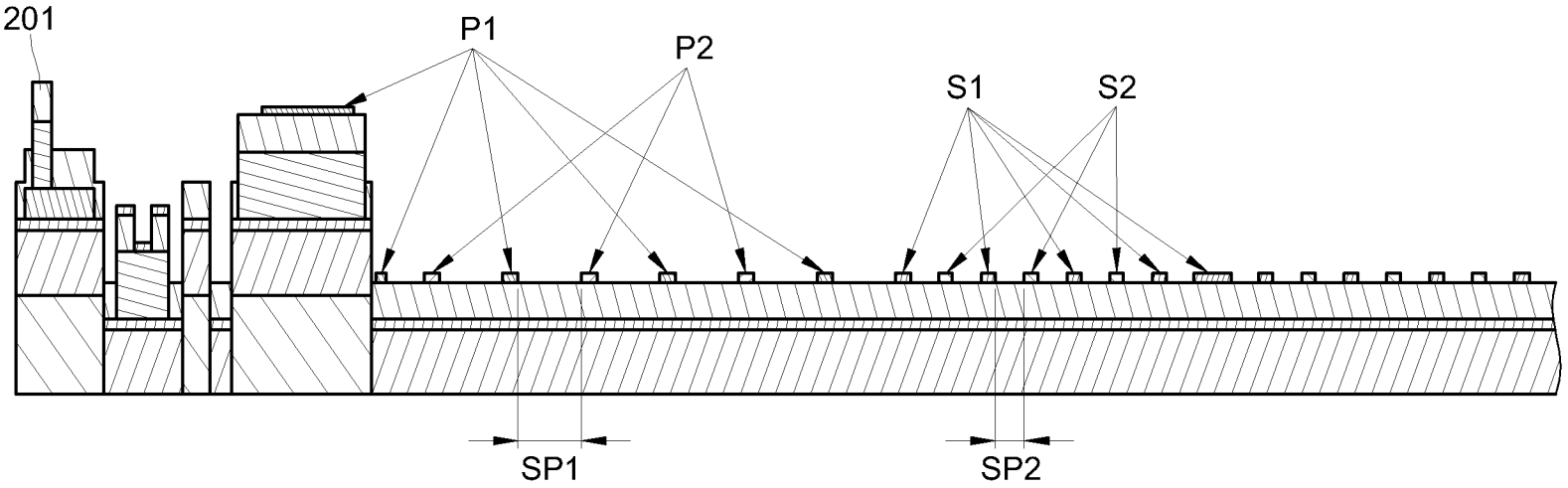
FIG. 7 is a sectional view of a pixel array circuit layout of a driving circuit in the disclosure.

FIG. 7 is a sectional view of the pixel array circuit layout 600 according to another embodiment of the disclosure. In FIG. 7, the sectional structure is a cross section of the pixel array circuit layout 600. The spacing SP1 between the first pixel electrode P1 and the second pixel electrode P2 is larger than the spacing SP2 between the third pixel electrode S1 and the fourth pixel electrode S2. In this and some embodiments, the spacings SP1 can be different, and the spacings SP2 can be different as well. The drive method and operation in an example of the disclosure are illustrated as follows.

Figure 8:
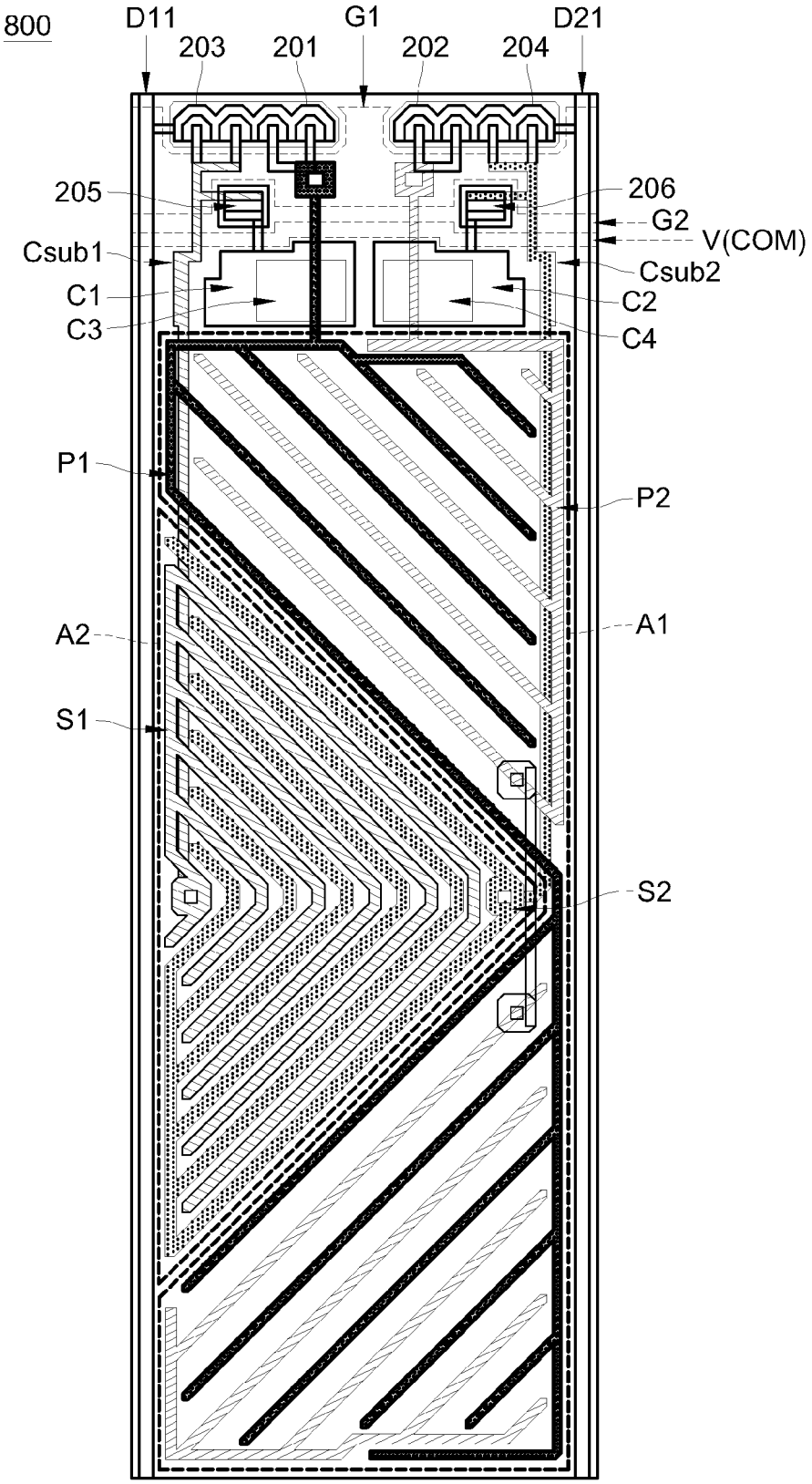
FIG. 8 is a schematic view of an electrode distribution of the pixel array circuit layout of a driving circuit in the disclosure.

FIG. 8 is a schematic view of an electrode distribution of the pixel array circuit layout of a driving circuit in the disclosure. The embodiment in FIG. 8 is not presented according to an actual scale, and the disposition manner of electrodes in FIG. 8 does not limit the disclosure. A pixel array circuit layout 800 includes a first section A1 and a second section A2. The first pixel electrode P1 and the second pixel electrode P2 are disposed in the first section A1, and the third pixel electrode S1 and the fourth pixel electrode S2 are disposed in the second section A2. The first section A1 and the second section A2 are adjacent to each other and do not overlap each other. The first section A1 is partially adjacent to the first voltage dividing unit CS1 and the second voltage dividing unit CS2, and the first section A1 is where the liquid crystal capacitor CLC is disposed. The second section A2 is where the second liquid crystal capacitor CLC2 is disposed. A sum of the area of the first section A1 and the area of the second section A2 is equal to an area of an open section in the pixel array circuit layout 800.

In order to estimate the performance of display device or panel, an exemplary simulation is performed on the area distribution of the first section A1 and the second section A2 according to two simulation conditions. One of the simulation conditions is a vertical alignment In-Plane Switching (VA-IPS) mode, and the other one of the simulation conditions is the VA-IPS mode with the charge sharing technique.

A voltage difference ratio (VDR) indicates a ratio of the voltage difference between the electrodes of the liquid crystal capacitor CLC to the voltage difference between the electrodes of the second liquid crystal capacitor CLC2. The first section A1 includes an area 1 and an area 2 in both of which the liquid crystal capacitor CLC is laid out. The second section A2 includes an area 3 where the second liquid crystal capacitor CLC2 is laid out. For example, an upper part of the first section A1 in FIG. 8 includes a part of the areas 1 and 2, and a lower part of the first section A1 includes the other part of the areas 1 and 2. When the area 1 and the area 2 are arranged in the first section A1 averagely, the color washout at every view angle may be the same. A spacing 1 is the distance between the electrodes in the area 1, a spacing 2 is the distance between the electrodes in the area 2, and a spacing 3 is the distance between the electrodes in the area 3.

The aforementioned parameters such as the voltage difference ratio, the areas 1 to 3 and the spacings 1 to 3 are employed to estimate the performance of display device or panel and then obtain D-values which present the color washout level. The less the D-value is, the less the color washout level is, which results in the better performance.

TABLE 1

| | | First section A1 | | Second section A2 | |
|---|---|---|---|---|---|
| Mode | VDR | Spacing 1(um)/ Area 1(%) | Spacing 2 (um)/ Area 2(%) | Spacing 3 (um)/ Area 3(%) | D-value |
| VA-IPS | 1:0.7 | 4/16 | 14/54 | 16/30 | 0.196 |
| With charge | 1:0.6 | 6/13 | 16/42 | 14/45 | 0.169 |
| sharing | 1:0.7 | 6/16 | 14/31 | 14/53 | 0.177 |
| technique | 1:0.8 | 4/11 | 12/13 | 14/76 | 0.185 |
| | 1:0.9 | 6/14 | 10/9 | 14/77 | 0.205 |
| | 1:0.7 | 6/2 | 12/3 | 14/95 | 0.270 |
| VA-IPS | 1:1 | 4/17 | 10/8 | 14/75 | 0.225 |

Table 1 shows that most of the D-values obtained under the VA-IPS mode with the charge sharing technique are less than the D-values obtained under the VA-IPS mode without the charge sharing technique. In other words, the VA-IPS mode with the charge sharing technique has smaller color washout. Specifically, when an area ratio of the first section A1 to the second section A2 is between 5:95 and 70:30, lower D-values can be obtained. Therefore, the color washout to the LCD can be reduced. On the other hand, even though the VA-IPS mode with the charge sharing technique has a higher D-value than the VA-IPS mode when the area ratio of the first section A1 to the second section A2 is 5:95, such a result is still acceptable as compared with that of a conventional display panel.

The D-value is obtained by averaging all the gray scales. If the gray scales incline to a specific gray scale, this D-value will become higher. Herein, a tone rendering distortion index (TRDI), which assesses the image quality degradation at the side view via the distortion within a display of the tone rendering curve (TRC), can be further estimated according to the aforementioned parameters. The less the TRDI is, the better the performance will be. An exemplary simulated result of the TRDIs based on the area of the first section A1 and of the second section A2 is shown in Table 2.

TABLE 2

| | | First section A1 | | Second section A2 | |
|---|---|---|---|---|---|
| Mode | VDR | Spacing 1(um)/ Area 1(%) | Spacing 2(um)/ Area 2(%) | Spacing 3(um)/ Area 3(%) | TRDI |
| VA-IPS | 1:0.7 | 4/10 | 14/60 | 16/30 | 0.143 |
| Mode with | 1:0.6 | 4/5 | 16/46 | 14/49 | 0.130 |
| Charge | 1:0.7 | 4/6 | 14/36 | 16/58 | 0.129 |

TABLE 2-continued

| | | First section A1 | | Second section A2 | |
|---|---|---|---|---|---|
| Mode | VDR | Spacing 1(um)/ Area 1(%) | Spacing 2(um)/ Area 2(%) | Spacing 3(um)/ Area 3(%) | TRDI |
| sharing | 1:0.8 | 4/7 | 12/8 | 16/85 | 0.132 |
| technique | 1:0.9 | 4/7 | 10/6 | 14/87 | 0.147 |
| | 1:0.7 | 6/2 | 12/3 | 14/95 | 0.158 |
| VA-IPS Mode | 1:1 | 4/8 | 10/5 | 16/87 | 0.165 |

Table 2 shows that the TRDI of the VA-IPS mode with the charge sharing technique is lower than the TRDI of the VA-IPS mode. Specifically, when the area ratio of the first section A1 to the second section A2 is between 5:95 and 70:30, the TRDIs will be lower, whereby the color washout of the LCD can be reduced.

Figure 9:
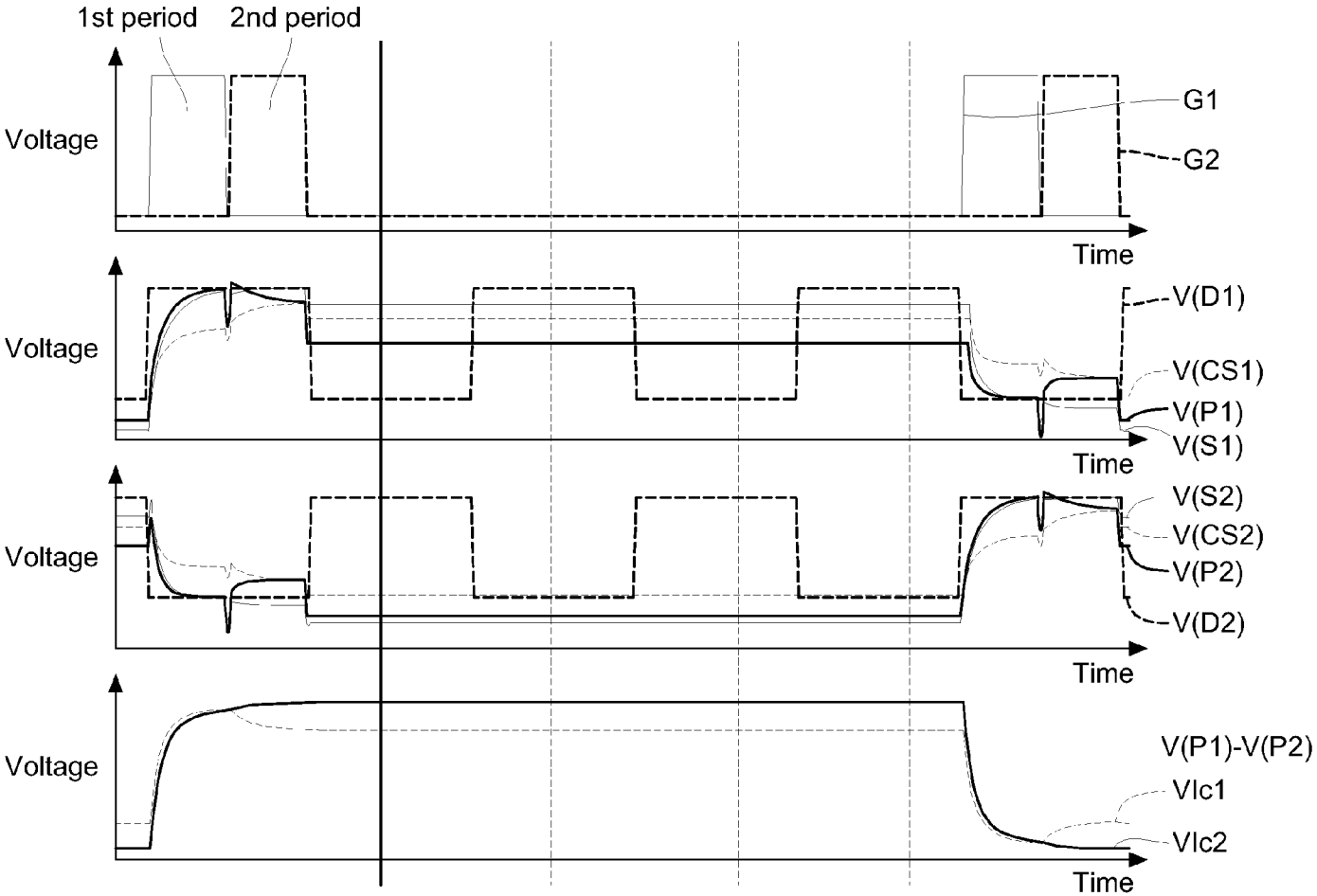
FIG. 9 is a simulation waveform diagram of a driving circuit in the disclosure.

FIG. 9 is a simulation waveform diagram of the driving circuit 500. When the first data voltage is at a positive potential, the second data voltage is at a negative potential.

In a first period, when the first switch 201, the second switch 202, the third switch 203 and the fourth switch 204 are turned on and the scan line G1 is enabled, a first data voltage is supplied to the first sub-capacitor Csub1 and the first storage capacitor Cst1 through the first data line D11, and a second data voltage is supplied to the second sub-capacitor Csub2 and the second storage capacitor Cst2 through the second data line D21. Herein, the potential of the voltage V(CS1) of the first voltage dividing unit CS1 is changed from the potential at the previous period to a higher potential, and the potential of the voltage V(CS2) of the second voltage dividing unit CS2 is also changed to a lower potential. Thus, the potentials of the first pixel electrode P1, the second pixel electrode P2, the third pixel electrode S1 and the fourth pixel electrode S2 are changed to the potential of a corresponding data voltage respectively.

Subsequently, in the second period, the fifth switch 205 and the sixth switch 206 are turned on, and the first data voltage maintained by the first sub-capacitor Csub1 and the first voltage dividing unit CS1 is redistributed, and the second data voltage maintained by the second sub-capacitor Csub2 and the second voltage dividing unit CS2 is redistributed. When the scan line G1 is disabled and the scan line G2 is enabled, the charges originally stored in the first sub-capacitor Csub1 are redistributed via the first capacitor C1 and the third capacitor C3, and the charges stored in the second sub-capacitor Csub2 are redistributed via the second capacitor C2 and the fourth capacitor C4. Specifically, the node S1 shares the charges with the first voltage dividing unit CS1, and the second voltage dividing unit CS2 shares the charges with the node S2. Thus, the potential of the node S1 and the potential of the first voltage dividing unit CS1 become equal, the potential of the node S2 and the potential of the second voltage dividing unit CS2 become equal, the potential of the voltage V(P1) of the first pixel electrode P1 is changed to a higher potential, and the potential of the voltage V(P2) of the second pixel electrode P2 is changed to a lower potential. A voltage, being equal to the voltage V(P1) minus the voltage V(P2), between the first pixel electrode P1 and the second pixel electrode P2 is increased to be higher than a drive range of the data voltage. The voltage difference Vlc2 between the third pixel electrode S1 and the fourth pixel electrode S2 of the second liquid crystal capacitor CLC2 is changed according to the voltage change between the first sub-capacitor Csub1 and the second sub-capacitor Csub2, and the voltage difference Vlc2 for the second liquid crystal capacitor CLC2 is lower.

In the first period, when the scan line G1 is enabled, the first switch 201, the second switch 202, the third switch 203 and the fourth switch 204 are turned on. Herein, the first data voltage V(D1) is supplied, and the second data voltage V(D2) is supplied. Thus, the voltage V(P1) of the first pixel electrode P1 and the voltage V(S1) of the third pixel electrode S1 increase with the first data voltage V(D1), and the voltage V(P2) of the second pixel electrode P2 and the voltage V(S2) of the fourth pixel electrode S2 decrease with the second data voltage V(D2). The first pixel electrode P1 and the third pixel electrode S1 are fully charged via the first data line D11 to become positive electrodes, and the second pixel electrode P2 and the fourth pixel electrode S2 are fully charged via the second data line D21 to become negative electrodes.

Subsequently, when the scan line G1 is disabled and the scan line G2 is enabled, the first switch 201, the second switch 202, the third switch 203 and the fourth switch 204 are turned off, and the fifth switch 205 and the sixth switch 206 are turned on. Herein, the charges originally stored in the first sub-capacitor Csub1 are redistributed via the first voltage dividing unit CS1 formed by the first capacitor C1 and the third capacitor C3. After the charges are shared, the potential of the voltage V(P1) of the first pixel electrode P1 increases, and the voltage V(S1) of the third pixel electrode 51 decreases. Moreover, the charges stored in the second sub-capacitor Csub2 are also redistributed via the second capacitor C2 and the fourth capacitor C4, so that the potential of the voltage V(P2) of the second pixel electrode P2 decreases, and the potential of the voltage V(S2) of the fourth pixel electrode S2 increases. Therefore, the voltage difference Vlc1 for the liquid crystal capacitor CLC is equal to the voltage V(P1) minus the voltage V(P2), is greatly enhanced and becomes much higher than the drive voltage range. The voltage difference between the voltage V(S1) of the third pixel electrode 51 and the voltage V(S2) of the fourth pixel electrode S2 controls the voltage difference Vlc2 of the second liquid crystal CLC2, and the voltage difference Vlc2 of the second liquid crystal capacitor CLC2 is smaller. This embodiment has two stages, one is that the voltage equal to the voltage V(P1) minus the voltage V(P2) is used for driving the liquid crystal capacitor CLC having a larger spacing, and the other one is that the voltage equal to the voltage V(S1) minus the voltage V(S2) is used for driving a second liquid crystal capacitor CLC2 having a smaller spacing. Thus, the disclosure may satisfy the demand of the capacitor having a small spacing. However, the disclosure is not limited thereto, and is also operable when the spacing between the third pixel electrode 51 and the fourth pixel electrode S2 is larger than the spacing between the first pixel electrode P1 and the second pixel electrode P2.

For a driving circuit according to the disclosure, charges originally stored in the sub-capacitors can be redistributed through the voltage dividing units, and the spacing between two pixel electrodes of a liquid crystal capacitor can be designed to be the same as or different from that of another liquid crystal capacitor, especially when two spacing respectively associates with two liquid crystal capacitors, the layout area occupied by the sub-capacitors may be reduced. Moreover, through the structure of the driving circuit, the sharing of charges and the drive method of two data lines, the liquid crystal capacitor may have a higher voltage difference between its electrodes, and the aperture ratio of pixel may be increased. Thus, liquid crystal molecules are driven by a stronger electrical field and have a larger tilt angle, thereby obtaining a better transmittance to correct the color washout at the side view. Moreover, when the area ratio of the first section to the second section is between 5:95 and 70:30, the disclosure may have a lower TRDI, thereby reducing the color washout.

What is claimed is:

1. A driving circuit, electrically coupled between a first data line and a second data line, and electrically coupled between a first scan line and a second scan line, and the driving circuit comprising:

a first switch, having a first end, a second end and a control end, the first end of the first switch being electrically connected to the first data line, the second end of the first switch being electrically connected to a first pixel electrode, and the control end of the first switch being electrically connected to the first scan line;

a second switch, having a first end, a second end and a control end, the first end of the second switch being electrically connected to the second data line, the second end of the second switch being electrically connected to a second pixel electrode, and the control end of the second switch being electrically connected to the first scan line;

a third switch, having a first end, a second end and a control end, the first end of the third switch being electrically connected to the first data line, and the control end of the third switch being electrically connected to the first scan line;

a fourth switch, having a first end, a second end and a control end, the first end of the fourth switch being electrically connected to the second data line, and the control end of the fourth switch being electrically connected to the first scan line;

a first sub-capacitor, electrically connected between the second end of the third switch and a reference voltage end;

a second sub-capacitor, electrically connected between the second end of the fourth switch and the reference voltage end;

a fifth switch, having a first end, a second end and a control end, the first end of the fifth switch being electrically connected to the second end of the third switch, and the control end of the fifth switch being electrically connected to the second scan line;

a sixth switch, having a first end, a second end and a control end, the first end of the sixth switch being electrically connected to the second end of the fourth switch, and the control end of the sixth switch being electrically connected to the second scan line;

a first voltage dividing unit, coupled between the second end of the fifth switch and the reference voltage end; and a second voltage dividing unit, coupled between the second end of the sixth switch and the reference voltage end.

2. The driving circuit according to claim 1, further comprising:

a third pixel electrode, electrically connected to the second end of the third switch; and a fourth pixel electrode, electrically connected to the second end of the fourth switch.

3. The driving circuit according to claim 2, wherein the driving circuit has a pixel array circuit layout comprising a first section and a second section, the first pixel electrode and the second pixel electrode are disposed in the first section, the third pixel electrode and the fourth pixel electrode are disposed in the second section, the first section does not overlap the second section, and an area ratio of the first section to the second section is between 5:95 and 70:30.

4. The driving circuit according to claim 2, wherein the first voltage dividing unit comprises a first voltage divider electrically connected between the second end of the fifth switch and the reference voltage end, and the second voltage dividing unit comprises:

a second voltage divider electrically connected between the second end of the sixth switch and the reference voltage end.

5. The driving circuit according to claim 4, wherein the first voltage dividing unit comprises a third capacitor electrically connected between the second end of the first switch and the second end of the fifth switch, and the second voltage dividing unit comprises a fourth capacitor electrically connected between the second end of the second switch and the second end of the sixth switch.

6. The driving circuit according to claim 2, further comprising:

a first storage capacitor, electrically connected between the second end of the first switch and the reference voltage end; and a second storage capacitor, electrically connected between the second end of the second switch and the reference voltage end.

7. The driving circuit according to claim 1, wherein the first voltage dividing unit comprises a first voltage divider electrically connected between the second end of the fifth switch and the reference voltage end, and the second voltage dividing unit comprises a second voltage divider electrically connected between the second end of the sixth switch and the reference voltage end.

8. The driving circuit according to claim 7, wherein the first voltage dividing unit comprises a third capacitor electrically connected between the second end of the first switch and the second end of the fifth switch, and the second voltage dividing unit comprises a fourth capacitor electrically connected between the second end of the second switch and the second end of the sixth switch.

9. The driving circuit according to claim 1, further comprising:

a first storage capacitor, electrically connected between the second end of the first switch and the reference voltage end; and a second storage capacitor, electrically connected between the second end of the second switch and the reference voltage end.

10. A driving circuit, electrically coupled between a first data line and a second data line, and electrically coupled between a first scan line and a second scan line, and the driving circuit comprising:

a first switch, having a first end, a second end and a control end, the first end of the first switch being electrically connected to the first data line, the second end of the first switch being electrically connected to a first pixel electrode, and the control end of the first switch being electrically connected to the first scan line;

a second switch, having a first end, a second end and a control end, the first end of the second switch being electrically connected to the second data line, the second end of the second switch being electrically connected to a second pixel electrode, and the control end of the second switch being electrically connected to the first scan line;

a third switch, having a first end, a second end and a control end, the first end of the third switch being electrically connected to the first data line, and the control end of the third switch being electrically connected to the first scan line;

a fourth switch, having a first end, a second end and a control end, the first end of the fourth switch being electrically connected to the second data line, and the control end of the fourth switch being electrically connected to the first scan line;

a first sub-capacitor, electrically connected between the second end of the third switch and a reference voltage end;

a second sub-capacitor, electrically connected between the second end of the fourth switch and the reference voltage end;

a fifth switch, having a first end, a second end and a control end, the first end of the fifth switch being electrically connected to the second end of the third switch, and the control end of the fifth switch being electrically connected to the second scan line;

a sixth switch, having a first end, a second end and a control end, the first end of the sixth switch being electrically connected to the second end of the fourth switch, and the control end of the sixth switch being electrically connected to the second scan line;

a first voltage dividing unit, coupled between the second end of the fifth switch and the reference voltage end;

a second voltage dividing unit, coupled between the second end of the sixth switch and the reference voltage end;

a third pixel electrode electrically connected to the second end of the third switch; and a fourth pixel electrode electrically connected to the second end of the fourth switch, wherein the first pixel electrode and the second pixel electrode are disposed in a first section, the third pixel electrode and the fourth pixel electrode are disposed in a second section, the first section does not overlap the second section, and an area ratio of the first section to the second section is between 5:95 and 70:30.

* * * * *